US005476062A

United States Patent [19]

Ondris et al.

[11] Patent Number: 5,476,062

[45] Date of Patent: Dec. 19, 1995

[54] SEAGULL GUARD

[76] Inventors: Fred Ondris, 80 Hicks La., Great Neck, N.Y. 11024; Christopher Byrne, 25 Bayview Ct., Manhasset, N.Y. 11030

[21] Appl. No.: 250,292

[22] Filed: May 27, 1994

[51] Int. Cl.[6] ..... B63B 17/00

[52] U.S. Cl. ..... 114/343; 52/101; 119/903

[58] Field of Search ..... 114/343, 90, 361, 114/230, 364; 52/101; 119/903; 116/22 A; 242/378, 378.4; 441/1

[56] References Cited

U.S. PATENT DOCUMENTS

| | | | |
|---|---|---|---|
| D. 303,225 | 9/1989 | Niebling, Sr. | D10/109 |
| 2,326,289 | 8/1943 | Shong | 114/90 |
| 2,596,678 | 5/1952 | Gross, Jr. . | |
| 2,666,934 | 1/1954 | Leifheit | 114/230 |
| 2,872,047 | 2/1959 | Ostlund | 242/378 X |
| 3,292,319 | 6/1964 | McCarthy . | |
| 4,016,823 | 4/1977 | Davis | 114/90 |
| 4,143,437 | 3/1979 | Voykin | 441/1 |
| 5,341,759 | 8/1994 | Hood | 52/101 X |

FOREIGN PATENT DOCUMENTS

| | | | |
|---|---|---|---|
| 0600526 | 6/1960 | Canada | 242/378.4 |
| 2250172 | 6/1992 | United Kingdom | 51/101 |

*Primary Examiner*—Sherman Basinger
*Attorney, Agent, or Firm*—Collard & Roe

[57] ABSTRACT

A device prevents birds from flying near and landing on a boat having a periphery. The device includes a post centrally mounted on the boat with a top end position above the highest point of the boat. A series of cables extends between the top end of the post and peripheral points on the boat. The cables can be detached and the post can be retracted during use of the boat. The cables interrupt the flight paths of the birds and prevent them from landing or flying near the boat.

8 Claims, 2 Drawing Sheets

SEAGULL GUARD

BACKGROUND OF THE INVENTION

1. Field of the Invention

The present invention relates to a seagull guard for use on marine craft. More particularly, it relates to a seagull guard for preventing seagulls from landing or flying close to boats.

2. The Prior Art

Marine craft suffer considerable damage from the members of the gull family, inhabiting the coastal regions adjacent large bodies of water. Numerous deterrents have been devised to discourage seagulls from alighting on flat structures of marine crafts. Included amongst such devices are small flags, nets, stuffed or papier mâché owls, other noisemakers, and the like. The underlying features of such devices resides in a loud noise, obstruction or instilling of fear to repel the intruder. In all instances, very little success in the attainment of the overall objective is achieved after the gulls become familiar with, and learn to avoid, the deterrent.

Several attempts have been made to develop an improved seagull guard, as set forth in U.S. Pat. No. 2,596,678 to W. W. Gloss, Jr.; U.S. Pat. No. 3,292,3 19 to McCarthy; and U.S. Pat. No. D303,225 to Neibling, Sr. However, these devices are limited in that they span only a relatively small area of the boat. The prior art seagull guards may be mounted on the roof of the cabin to prevent birds from alighting thereon. However, these devices do not effectively prevent seagulls or other birds from landing on other parts of the boat.

SUMMARY OF THE INVENTION

It is therefore an object of the present invention to provide a seagull guard that overcomes the deficiencies of the prior art to effectively prevent birds from landing on any part of the boat.

It is a further object of the present invention to provide a seagull guard that can be quickly and easily stored when the boat is in use.

It has been observed that sailboats have very few problems with seagulls in that the shrouds which extend from the mast onto the side of the boat deter birds. It is believed that the cables interrupt the birds' flight patterns, whereby the birds avoid flying in the vicinity of the cables because of possible injury to their wings. It is, accordingly, another object of the present invention to provide power boats or motor boats with cables that deter birds from landing on the boat.

These and other related objects according to the invention are achieved by a device for preventing birds from flying near, and landing on, a boat having a periphery. The device includes a post having a top end which is mounted on the boat with the top end positioned above the boat. A plurality of cables are removably connected between the top end of the post and the periphery of the boat. The post includes a hollow interior for storing the cable, and a cap for covering the hollow interior. The post is a telescoping column which is movable between an extended position for connecting the cables thereto and a retracted position for storing the cables therein. In a retracted position, the top end of the post is ideally flush with a top surface of the boat where the post is mounted, so that the post and cables are hidden from view during use of the boat.

The cables are elastic and are equipped with one set of connectors for connecting to the post and a second set of connectors for connecting to the boat periphery. The connectors may be S-hooks designed to be retained within cooperatively sized apertures. Alternatively, the cables may be permanently connected to the hollow interior of the post. In addition, a large variety of clips may be employed. As a safety consideration, the cables connected on the starboard side of the post are colored green, and the cables connected on the port side of the post are colored red. At least one red cable and one green cable extend to the bow of the boat, and at least one red cable and one green cable extend to the stern of the boat. Alternatively, one or more retractable clothesline-type mechanisms may be disposed at the top end of the post. During use, the post is raised to its extended position and the cables are simply extended from the self-winding mechanism similar to an auto-rewind clothesline, an auto-rewind dog leash, or an electrical cord auto-rewind on a vacuum cleaner.

BRIEF DESCRIPTION OF THE DRAWINGS

Other objects and features of the present invention will become apparent from the following detailed description considered in connection with the accompanying drawings, which discloses the embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

Figure 1:
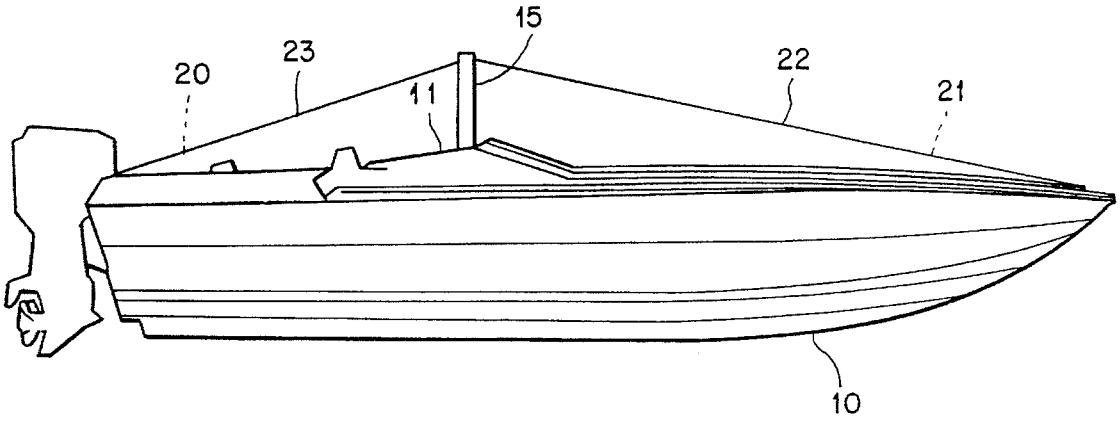
FIG. 1 is a left-side elevational view of a boat showing an embodiment of the invention.
Figure 2:
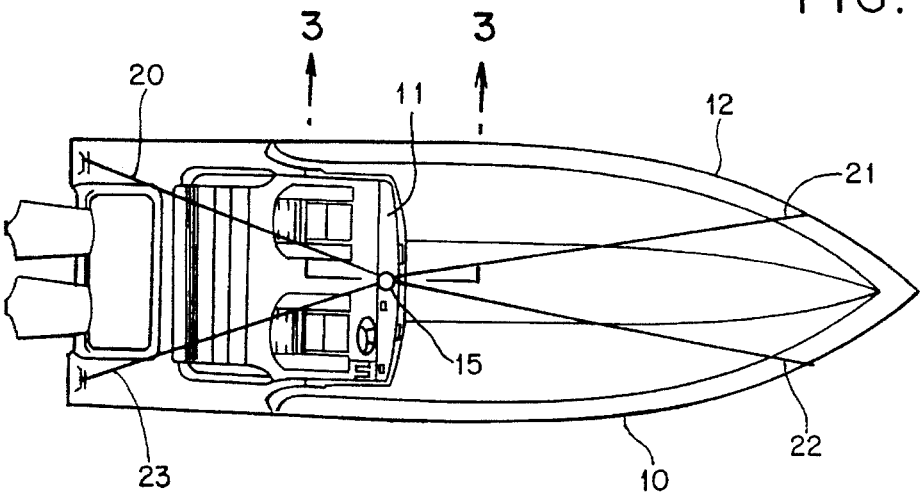
FIG. 2 is a top plan view thereof.

Referring now in detail to the drawings, and in particular, FIGS. 1 and 2, there is shown an motorboat 10 with a post 15 mounted on a top surface 11 of the boat. Several cables 20, 21, 22 and 23 extend from a top end of post 15 to various points along a periphery 12 of boat 10.

Post 15 is shown mounted on the top surface 11 of the dashboard of the boat. Post 15 may be positioned in any convenient location on the boat, with the position being ideally centrally located on the boat and on as high a surface as possible. The post should be centrally located so that each of the cables is of approximately the same length. The post should be mounted on as high a surface as possible so that the cables slope downwardly as they extend from the post to the peripheral point on the boat. Since the cables, and in particular cables 20 and 23, would interfere with use of the boat, it is intended that the cables be removed and the post retracted during use of the boat.

Figure 3:
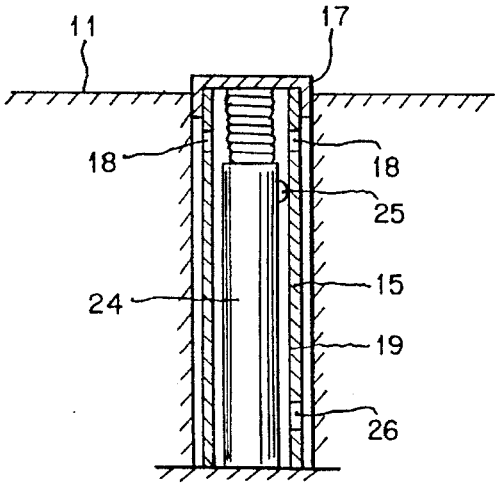
FIG. 3 is a cross-sectional view, taken along the line 3—3, of FIG. 2, with the post retracted.
Figure 4:
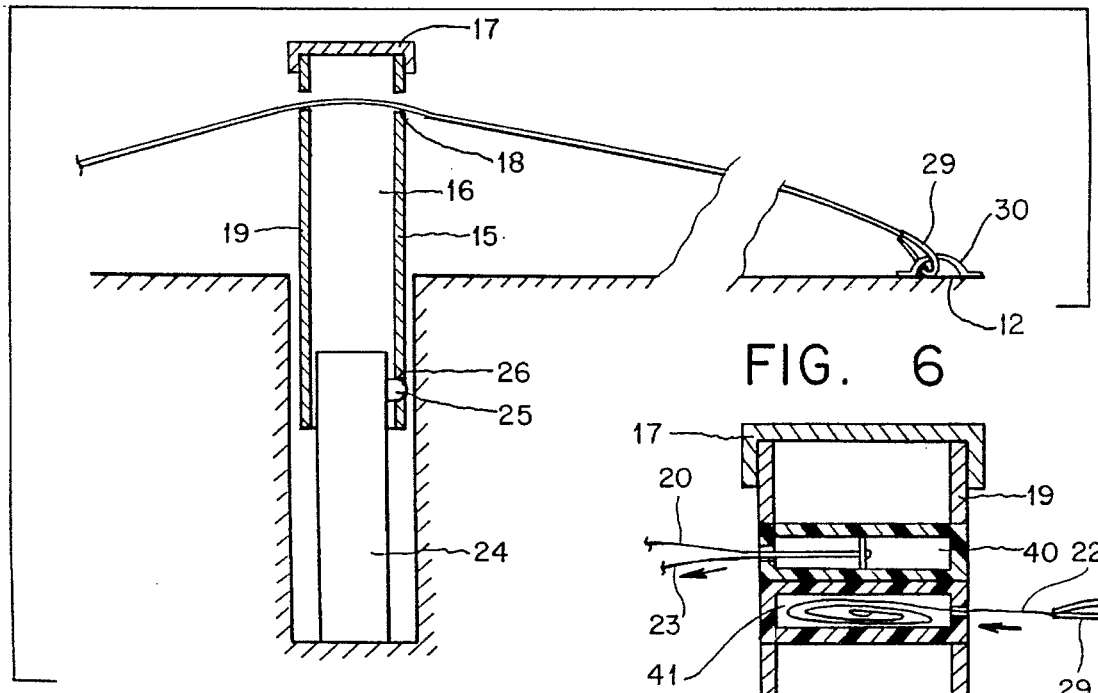
FIG. 4 is a cross-sectional view, similar to FIG. 3, with the post extended and cables attached.

Post 15 may be retracted and the cables removed and stored, as can be seen in FIG. 3. Post 15 consists of an outer telescoping member 19 and an inner guide member 24. Inner guide member 24 is securely attached at its lower end to part of the boat with outer telescoping member 19 slidably disposed thereon. Inner guide member 24 is equipped with one or more spring-loaded ball bearings 25 near its upper end. Telescoping member 19 is provided with correspondingly sized locking apertures 26. When telescoping member 19 is raised, as can be seen in FIG. 4, ball bearing 25 engages locking aperture 26 to keep telescoping member 19 in the extended position. Post 15 has a hollow interior 16 which is dimensioned slightly longer than guide member 24. As a result, a small space exists above guide member 24 even when telescoping member 19 is fully retracted, as can be seen in FIG. 3. Access to this space is provided through a cap 17. Ideally, hollow interior 16 is used to store the cable when telescoping member 19 is retracted, during use of the boat.

One embodiment for removably connecting the cables to post 15 and boat periphery 12 is shown in FIG. 4. The upper end of telescoping member 19 is provided with one or more cable apertures 18 for receiving the cables. The post ends receive the cables which extend through cable apertures 18 to removably and slidably secure the cables to telescoping member 19. On the opposite end of the cables, a clip 29 is used to secure the cables to an eyehook 30 secured to boat periphery 12.

Figure 5:
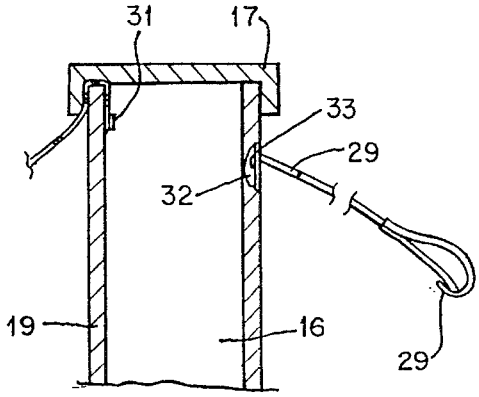
FIG. 5 is a cross-sectional view showing an alternate embodiments of the connecting element.

Two other embodiments for securing the cable to the post are shown in FIG. 5. In FIG. 5, a bolt or rivet 31 is shown permanently securing one end of the cable to the interior surface of telescoping member 19. The thin flexible cable simply passes underneath the cap, or fits within a correspondingly sized groove which is formed on the lower surface of cap 17. In this manner, the cables cannot be lost as they are securely attached to the post. In addition, the cables are secured in position so that cables of different length will always be in the proper position with respect to each other. Alternatively, a snap clamp 29 secured to the cable end is secured to a rod 33 that extends across an indentation 32 formed in the exterior surface of telescoping member 19.

Figure 6:
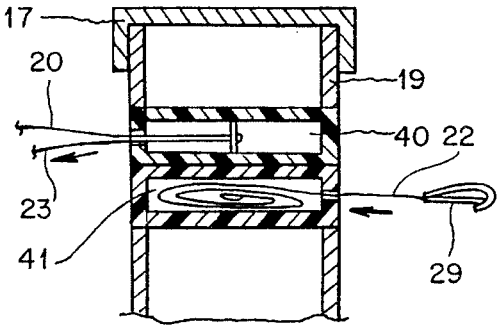
FIG. 6 is a further embodiment showing an auto-rewind mechanism.

A further embodiment is shown in FIG. 6 where auto-rewind mechanisms 40 and 41 are disposed within telescoping member 19 for conveniently retracting the cable when not being used. A separate auto-rewind mechanism may be provided for each cable, for example, cable 22 is shown with its own auto-rewind mechanism 41. Alternatively, two or more cables may be associated with a single auto-rewind mechanism, for example, cables 20 and 23 on auto-rewind mechanism 40. After use of the boat, telescoping member 19 is extended and locked and the cables are extended out from the corresponding auto-rewind mechanisms and clipped to the corresponding peripheral point.

The embodiment of FIG. 6 is particularly convenient in that the cables are always connected at the post end, which eliminates the possibility of losing or misplacing the cables. In addition, the cables may exit from the auto-rewind mechanisms in different directions, for example, facing the peripheral point to which they will ultimately be connected. This is particularly useful if the cables are to be color-coded, for example, green-colored cables on the starboard side of the boat and red cables on the port side of the boat. It should be understood that the auto-rewind mechanism, which operates in a manner similar to auto-retracting clotheslines and pet leashes, may also be provided at the peripheral point of the boat. In addition, the various connectors and connections may be provided at the post end or the boat end in any combination.

A distinct advantage of the auto-rewind mechanism is that a long length of cable may be provided therein sufficient for a particular class of boats. The same manufactured item could then be used on any smaller-sized boats, with the excess cable simply remaining coiled within the housing. This would avoid the need for having custom-cut cables dependent upon the size of the boat and position of the post within the boat.

While several embodiments of the present invention have been shown and described, it is to be understood that many changes and modifications may be made thereunto without departing from the spirit and scope of the invention as defined in the appended claims.

What is claimed is:

1. A device for preventing birds from flying near and landing on a boat having a periphery, the device comprising:

a plurality of cables;

a post having a top end, a hollow interior for storing said plurality of cable, and a removable cap for selectively covering said hollow interior, said post being adapted to be mounted on the boat with said top end positioned above the boat and;

means for removably connecting said plurality of cables between said top end of said post and the periphery of the boat.

2. The device according to claim 1, wherein said post is a telescoping column movable between an extended position for connecting said plurality of cables thereto and a retracted position for storing said plurality of cables therein, wherein in the retracted position the top end of the post is adapted to be flush with a top surface of the boat, so that said post and cables are hidden from view.

3. The device according to claim 2, wherein said cables are elastic and have a post end and a boat end.

4. The device according to claim 3, wherein said connecting means comprises a plurality of apertures, formed in said post adjacent the top end, cooperatively sized to removably and slidably retain said cables passing therethrough.

5. The device according to claim 3, wherein said connecting means comprises:

(i) permanently connecting the post ends of the cables to the hollow interior of the post; and (ii) mating connectors adapted for removably connecting the boat end of the cables to the periphery of the boat.

6. The device according to claim 5, wherein the cables permanently connected on the starboard side of the post are colored green and the cables permanently connected on the port side of the post are colored red.

7. The device according to claim 6, wherein at least one green cable and one red cable are adapted to extend to the bow of the boat and at least one green cable and one red cable are adapted to extend to the stern of the boat.

8. The device according to claim 2, wherein said connecting means comprises:

auto-rewind mechanisms disposed within said post for spooling the cables, one end of each of said cables being affixed to a corresponding one of the auto-rewind mechanisms.

* * * * *